United States Patent [19]

Komp

[11] 4,342,289

[45] Aug. 3, 1982

[54] INTERNAL COMBUSTION ENGINE, ESPECIALLY AIR-COOLED INTERNAL COMBUSTION ENGINE FOR VEHICLES AND DRIVING UNITS

[75] Inventor: Hermann-Josef Komp, Bad Münstereifel, Fed. Rep. of Germany

[73] Assignee: Klöckner-Humboldt-Deutz Aktiengesellschaft, Cologne, Fed. Rep. of Germany

[21] Appl. No.: 214,634

[22] Filed: Dec. 10, 1980

Related U.S. Application Data

[63] Continuation of Ser. No. 933,139, Aug. 14, 1978, abandoned.

[30] Foreign Application Priority Data

Aug. 12, 1977 [DE] Fed. Rep. of Germany ..... 2736378

[51] Int. Cl.[3] ..... F02P 1/02

[52] U.S. Cl. ..... 123/41.7; 123/195 A; 123/198 E

[58] Field of Search ..... 123/195 R, 195 A, 195 C, 123/198 E, 41.7, 41.57

[56] References Cited

U.S. PATENT DOCUMENTS

| | | | |
|---|---|---|---|
| 3,263,663 | 8/1966 | Connell | 123/195 R |
| 3,730,147 | 5/1973 | Buchwald | 123/195 A |
| 3,796,280 | 3/1974 | Thien et al. | 123/198 E |
| 4,071,008 | 1/1978 | Skatsche et al. | 123/198 E |
| 4,077,383 | 3/1978 | Hatz | 123/198 E |
| 4,125,036 | 11/1978 | Nakamura et al. | 123/195 A |

FOREIGN PATENT DOCUMENTS

| | | | |
|---|---|---|---|
| 335572 | 2/1959 | Switzerland | 123/195 A |

*Primary Examiner*—Craig R. Feinberg
*Attorney, Agent, or Firm*—Becker & Becker, Inc.

[57] ABSTRACT

An internal combustion engine, especially air-cooled internal combustion engine, for vehicles and driving units, including a plurality of cylinders and at least one auxiliary machine arranged on one end face of the crankcase and/or at least one auxiliary machine arranged laterally and above the crankcase within the region of the end face. The internal combustion engine includes a ventilator or cooling blower for a direct or indirect cooling of the cylinders. The ventilator or cooling blower has associated therewith a partition which is arranged transverse to the flow of the air conveyed in the direction of the at least one auxiliary machine and provided with at least one guiding wall arranged substantially transverse to the partition and preventing the cooling air from being short-circuited. The at least one auxiliary machine to be cooled is arranged ahead of the partition.

6 Claims, 6 Drawing Figures

INTERNAL COMBUSTION ENGINE, ESPECIALLY AIR-COOLED INTERNAL COMBUSTION ENGINE FOR VEHICLES AND DRIVING UNITS

This is a Continuation Application of parent application Ser. No. 933,139—Komp filed Aug. 14, 1978 (Monday), now abandoned.

The present invention relates to an internal combustion engine, especially air-cooled internal combustion engine, for vehicles or driving units comprising a plurality of cylinders arranged alongside each other or arranged serially with regard to each other, and furthermore comprising one or more auxiliary machines arranged on one end face of the crankcase and/or one or more auxiliary machines arranged laterally and above the crankcase within the region of the end face. More specifically, the present invention concerns an internal combustion engine of the just mentioned type which includes a ventilator or cooling blower for a direct or indirect cooling of the cylinders, while the ventilator or cooling blower has associated therewith a partition which is arranged transverse to the flow of the air conveyed in the direction of the auxiliary machine or machines. The partition is provided with one or more guiding walls arranged substantially transverse to the partition, the guiding wall or walls preventing the air conveyed directly or indirectly for cooling from being short-circuited.

With internal combustion engines of the above mentioned type there exists the further problem that in addition to the cylinders or cylinder heads of the internal combustion engine, also the auxiliary machine or machines and/or the drive therefor can be intensively cooled independently of the load acting on the internal combustion engine without running the risk of short-circuiting the cooling air. In addition to this problem there also exists the problem as far as possible to capsule off the internal combustion engine by a minimum of sound reducing means so that sound waves emanated by the internal combustion engine will not generate a noise which exceeds the permissible noise level. For solving this problem it has been suggested in connection with air-cooled internal combustion engines to arrange one or more auxiliary means outside of the cooling passage preceding the cylinders and to cool the internal combustion engine by conveying cooling air from the cooling air current to the cylinders through a gap located in the vicinity of the crankcase in the cooling housing between the blower and the cylinders, the gap extending substantially parallel to the axis of the crankshaft. In this connection it has been found that with internal combustion engines, which for purposes of noise reduction are enclosed with the exception of their bottom side, a satisfactory cooling of the auxiliary machines, such as a generator or compressor, cannot be assured, especially when the respective auxiliary machine is under a heavy or increased load. Moreover, if under such conditions the drive of the auxiliary machines is effected through the intervention of V-belts or the like, it has been found that the drive is likewise exposed to too high thermal stresses. Moreover, it has been found that a torsional vibration balancer arranged on the free end of the crankshaft of the internal combustion engine will, as to its dampening means formed of rubber or a synthetic material be exposed to too high temperatures reducing the useful lifespan of such dampening means.

Based upon the above findings, it is an object of the present invention to provide an internal combustion engine of the above mentioned general type, with which the auxiliary machine or machines driven by the internal combustion engine and, if required, the drive of the auxiliary machine or machines is exposed to a particularly effective cooling while the machine or machines are subjected to an optimum cooling and noise dampening, and while at the same time a particularly simple inspection and servicing of the units involved will be possible.

This object and other objects and advantages of the invention will appear more clearly from the following specification in connection with the accompanying drawings in which.

Figure 1:
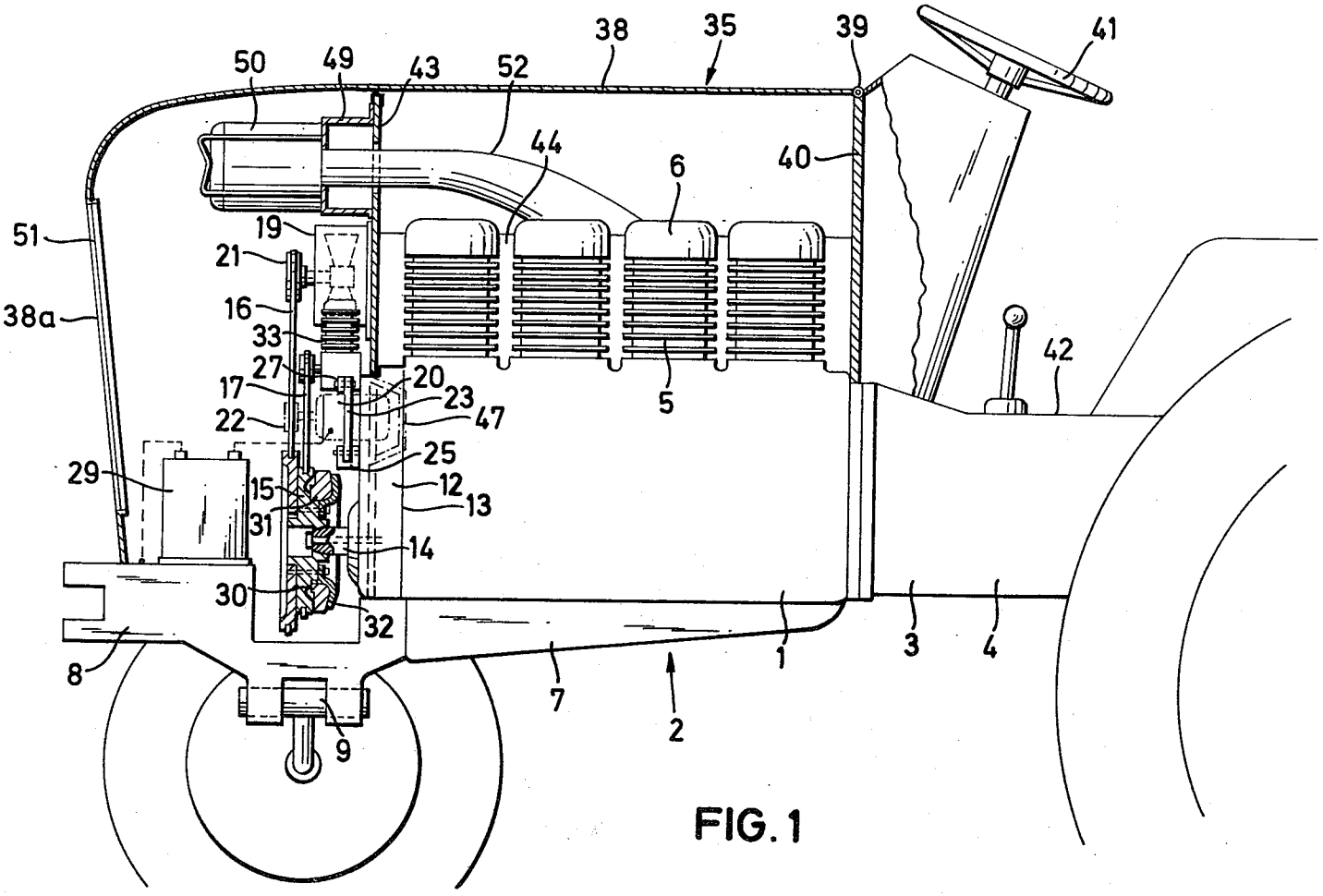
FIG. 1 represents a longitudinal section through a tractor with an internal combustion engine according to the present invention.

The internal combustion engine according to the invention includes one or more auxiliary machines located at one end face of the crankcase and also includes one or more auxiliary machines located laterally of the crankcase within the region of said one end face. The internal combustion engine furthermore includes a ventilator or blower for directly or indirectly cooling the cylinders, while the ventilator or blower has associated therewith a partition arranged transverse to the flow of the air conveyed substantially in the direction of the auxiliary machine or machines. The partition is provided with one or more guiding walls which prevent short-circuiting of the cooling air being conveyed. The internal combustion engine according to the invention is characterized primarily in that the auxiliary machine or machines to be cooled is or are arranged ahead of the partition. Such an arrangement in particular brings about the advantage that, in addition to creating an especially effective cooling of the auxiliary machine or machines, it is especially economical. Moreover, in this way a simple attending to and an easy mounting of the internal combustion engine in a vehicle is assured.

For reducing the overall length of the internal combustion engine it is expedient in this connection that the auxiliary machine or machines is or are partly surrounded by the partition. Such a solution creates in particular the possibility, by means of a ventilator provided on the auxiliary machine, intensively to directly ventilate the outer mantle of the auxiliary machine. Moreover, such a solution creates the advantage that, depending on the respective conditions with regard to the installation of the internal combustion engine, a removal of the auxiliary machine through the opening of the partition surrounding the same can be effected toward the cylinder side.

If the drive of the auxiliary machine or machines is effected through the intervention of a V-belt or the like, it is provided according to the invention that the drive of the auxiliary machine or machines precedes the partition. If the drive of the auxiliary machine or of the crankshaft of the internal combustion engine has associated therewith a torsional vibration balancer, according to a further development of the invention it is suggested that the torsional vibration balancer precedes the partition.

If the end wall of the internal combustion engine which is associated with the partition is directly or indirectly braced with a gearbox of a control drive for the internal combustion engine, it is provided according to a particularly economical construction of the invention that the gearbox is surrounded by the partition. In this connection is is expedient, for reducing the noise, to directly or indirectly connect the gearbox to the partition. For certain special cases of installation, especially those in which the partition is fixedly connected to a lateral cover, it is further suggested to connect the partition through elastic means to the gearbox.

If with an internal combustion engine the end wall which faces the partition is braced with a preceding gearbox through the intervention of an intermediate plate serving for mounting or enclosing the control drive or for mounting the drive of an auxiliary machine, it is provided according to a further development of the invention that the intermediate plate is directly or indirectly connected to the partition. In this connection it is advantageous for certain cases of utilization that the partition is connected to the intermediate plate by way of elastic means. Furthermore, a particularly favorable solution as far as the construction is concerned is obtained when the intermediate plate projects beyond the gearbox and is overlapped by one or more webs of an elastic intermediate member, which elastic intermediate member has one or more webs overlapping the partition or partitions. A particularly economical solution is realized in this connection when the intermediate plate forms one piece with the partition.

For a multi-use of the structural elements of the internal combustion engine, it is furthermore suggested according to the invention that the intermediate plate is designed as mount for the internal combustion engine in the vehicle frame or in the chassis.

For realizing a particularly effective noise abatement for the internal combustion engine, it is furthermore suggested to cover the partition on one or on both sides with a sound dampening material. Furthermore a particularly effective solution for the sound abatement of the internal combustion engine is obtained by making the partition of an elastic material with or without reinforcing means, such as glass windows, or the like.

For increasing the effectiveness of the cooling of the internal combustion engine and/or the sound abatement thereof, it is also suggested according to the invention to provide the partition with lateral sealing lips on its end faces which engage the guiding wall or walls. A further multi-use of the structural elements of the internal combustion engine is realized according to the invention by designing the partition as holding means for an auxiliary device of the internal combustion engine and/or the vehicle. In this connection it is advantageous when the partition at the same time forms a container for an auxiliary means of the internal combustion engine and/or of the vehicle.

Figure 3:
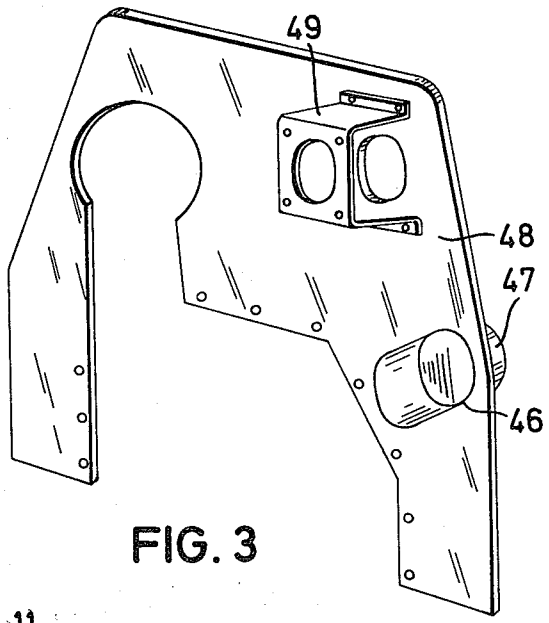
FIG. 3 is an isometric view of the partition of the internal combustion engine according to the invention.
Figure 2:
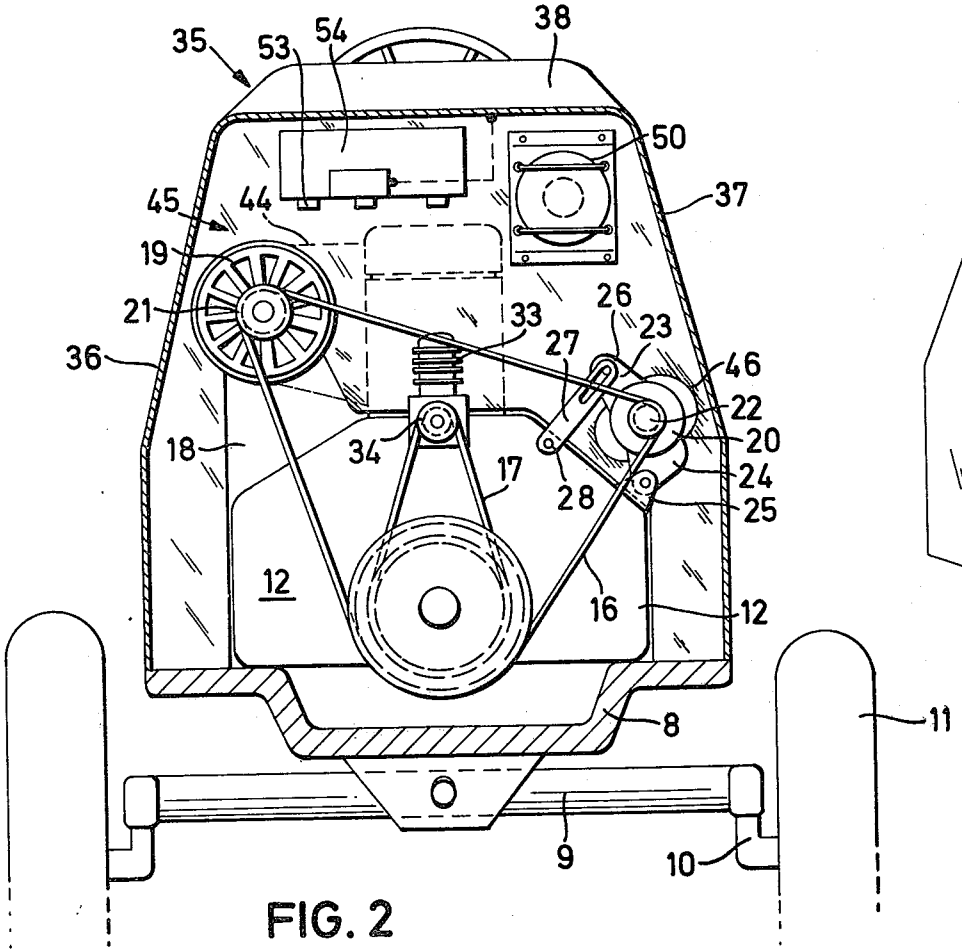
FIG. 2 illustrates a cross section through the tractor of FIG. 1, said cross section being taken along the line II—II of FIG. 1.

Referring now to the drawings in detail, in the embodiment of the invention shown in FIGS. 1 to 3, the crankcase 1 of an aircooled internal combustion engine 2 is associated on the side of the location of the fly-wheel (not shown), i.e. to the right of crankcase 1 (FIG. 1), with the clutch housing 3 of a transmission housing 4 to form a self-supporting unit so as to form at least part of the frame of the vehicle. Engine 2 comprises cylinders 5 with cylinder heads 6 and an oil pan 7. Engine 2 is supported, directly or indirectly, via crankcase 1 and/or oil pan 7 by the front axle support 8. A front axle 9 is journalled in support 8 and has control arms 10 for associated front wheels 11. The internal combustion engine 2 furthermore comprises a gearbox 12 which directly or indirectly is connected to an associated end face 13 of the crankcase 1, which end face faces away from the fly-wheel side (not shown).

In the gearbox 12 of engine 2 there is arranged a control drive, not shown, or similar drive means for the control of valves, not shown, and drive means for a fuel injection pump, not shown, the control drive being designed as gear drive or the like. Gearbox 12 has a passage therethrough for crankshaft 14 of the engine 2, and the end of the crankshaft shown in the drawing receives thereon a twin pulley 15 for V-belts 16 and 17 respectively. The V-belt 16, in addition to driving a cooling air blower 19 mounted on a support 18 of the gearbox 12 for supplying cooling air to the cylinders 5 and the cylinder heads 6, also drives a generator 20 forming an auxiliary machine and does so by way of an associated V-belt pulley 21, 22. The generator 20 is mounted in a rocker-like holder 23 which by means of an arm 24 is pivotally journalled in a bearing block or bracket 25 of the gearbox 12. The bearing block 25 is connected to an upper arm 26 by means of a spacer member 27 serving for tensioning the V-belt 16, the spacer member 27 being pivotally mounted on the gearbox 12 by means of a bolt 28. The generator 20 serves to supply current to the electrical system of the tractor, not shown in detail, and serves to charge the battery 29.

In order to dampen the vibrations caused by the crankshaft 14 and thereby to ensure a smooth running of the V-belt 16, a torsional vibration balancer 30 is provided which is comprised of a ring member 31 made of rubber or the like material, integrally molded onto a rotating ring 32. The V-belt 17 likewise drives an air compressor 33 representing an auxiliary machine and does so by way of a V-belt pulley 34. The air compressor 33 by means of its crankcase is fixedly connected to an associated receiving member for the gearbox. The air compressore 33 serves for supplying a compressed air network of the brake system of the tractor.

Similar to the part located above the front axle bearing block 8, the internal combustion engine 2 is covered on both sides and from above by a motor hood 34 having the side walls 37, 36 which may form one piece with the top part 38. In this connection, the top part 38 ends above the front axle bearing block 8 in a front part **38*a* (FIG. 1) with a grille section 51 through which the cooling and combustion air is drawn in for the combustion engine 2. If the lateral parts 36, 37 form a single integral piece with the top part 38, this top part 38 by means of a bearing 39 (not shown in detail) should be pivotable about a horizontal axle which is journalled transverse to the central longitudinal axis of the tractor and, more specifically, at the upper end of a rear partition 40 of the motor cover. The rear partition 40 which laterally follows the contour of the side parts 36, 37 and also follows the contour of the top part 38 is sealed with regard to these structural elements by a seal not shown in detail. The rearward wall 40 can be directly combined with the crankcase 1 of engine 2 and/or the clutch housing part 3 of the transmission housing 4 or indirectly by means of elastic intermediate members. Preferably, the inside and/or the outside surface of the rearward partition 40 is covered by sound abating means, such as for instance, sheets of polyurethane foam or the like. This will ensure that sound or noise emanating from the cylinders 5 and the cylinder heads 6 of engine 2 is suitably reduced on reaching the general area near the steering wheel 41 of the driver's seat 42**.

Ahead of the front portion 13 of the crankcase 1 there is provided a partition 43 connected to the gearbox 12 and/or the front bearing block 8, the partition tightly enclosing the gearbox 12. In accordance with the present invention, the auxiliary drive components, such as the generator 20 and the air compressor 33, are disposed ahead of this partition 43. Preferably, in this connection the drive for the generator 20 and the drive for the air compressor 30 as well as the cooling blower 19 and the torsional vibration balancer 30 of the crankshaft 14 are arranged ahead of the partition 43.

A hood-shaped cooling air duct 44 and the forward partion 43 form a cooling air passage 45 (FIG. 2) for cooling air to be directed to cylinder 5 and cylinder heads 6 of engine 2. The hood-shaped air duct 44 is located laterally with respect to crankcase 1, behind the blower 19 and forms an extension of the latter. In combination with the cylinders 5 and arranged alongside therewith, the partition 43 forms a cooling air passage for the cooling fins of the cylinders 5.

Furthermore, by means of the front partition 43 in combination with the lateral part 37 and the rear partition 40, a downwardly directed air withdrawing channel is formed for the heated cooling air. The front partition 43 preferably in the region of the generator 20 is provided with an oval recess 46 which partly extends around the generator 20 which latter is pivotable in the recess 46 about the bearing block 25. For covering up the recess 46, there is provided a cover 47 which is screwed onto the front partition, the cover 47 likewise partially surrounding the generator 20. A holder 49 is located above the V-belt 16, on the right-hand side of the end face 48 of the front partition 43. The end face is located behind the V-belt 16. The holder 49 for an air filter 50 is provided on the front partition 43. From the air filter 50, the combustion air drawn-in through the grille 51 of the motor hood 35 is conveyed to the individual cylinder heads 6 of the engine 2 through a suction conduit 52 which passes through the front partition 43. Laterally of the holder 49 there is furthermore provided a holder 53 for a supply container 54 and the pump of a non-illustrated windshield wiper system, the pump being integrated with the supply container 54.

Figure 4:
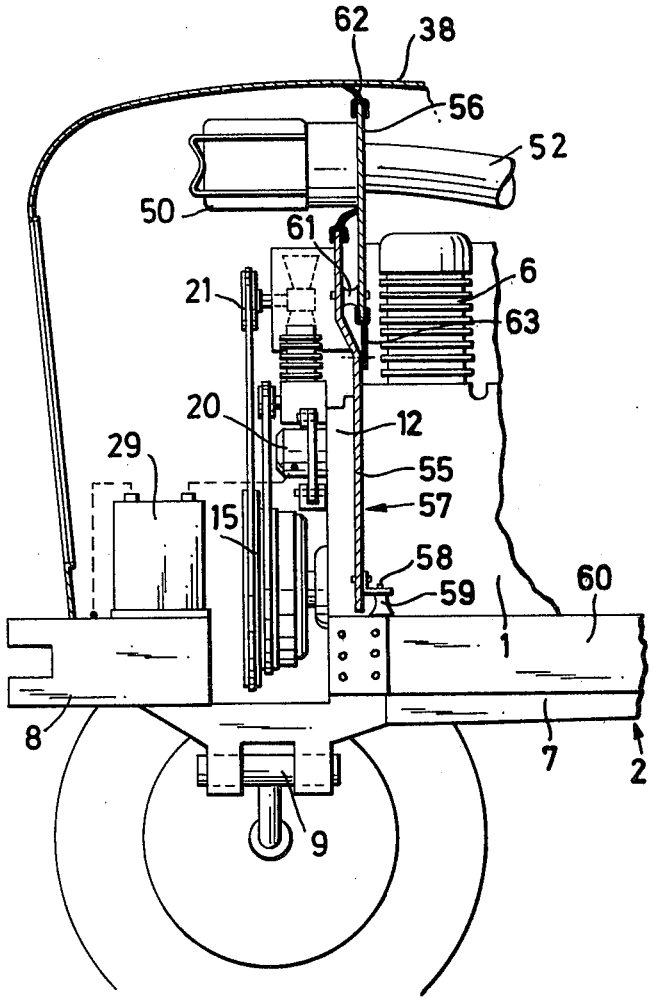
FIG. 4 shows an embodiment of the invention according to which the partition forms the mount for the internal combustion engine.

In contrast to the embodiment illustrated in FIGS. 1 to 3, with the embodiment of FIG. 4, the gear box 12 of the internal combustion engine 2 by way of an intermediate plate 55 serving for journalling the shafts of the control device is connected to the crankcase 1 of the internal combustion engine 2. The intermediate plate 55 at the same time forms a front partition 57 with an upper structural member 56 while the intermediate plate 55, as a mounting for the internal combustion engine 2, is connected by means of a holder 58 to a vehicle frame 60 with elastic intermediate bearings 59 being interposed. In this connection, the upper structural member 56 of the front partition 57 is connected to the intermediate plate 55 by means of elastic intermediate bearings 61. The plate 55 is, similar to the upper structural member 56 of the front partition 57, sealed by means of a seal with a sealing lip relative to the upper part 39 of the motor hood 35 or its lateral parts 36 and 37. Furthermore, the upper structural member 56 of the front partition 57 is sealed relative to the intermediate plate 55 by means of a seal 63 formed of elastic material.

Figure 6:
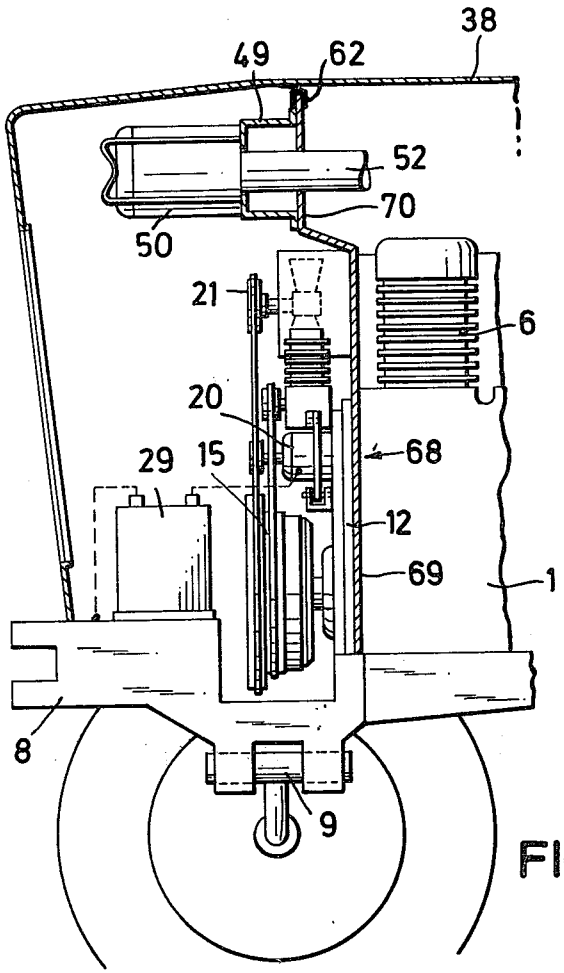
FIG. 6 shows still another embodiment of the invention.
Figure 5:
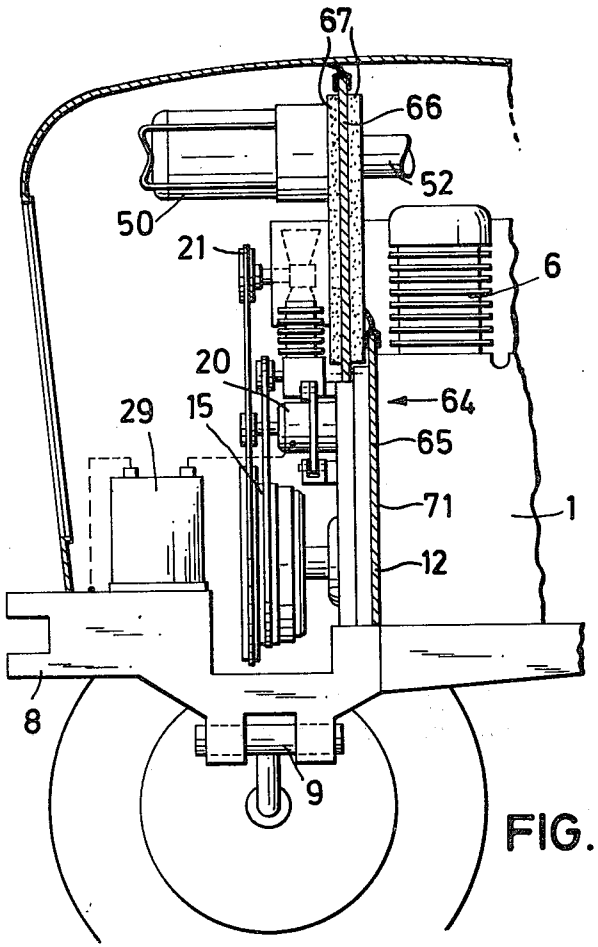
FIG. 5 illustrates another embodiment of the invention according to which the intermediate plate of a gearbox of the internal combustion engine forms at least a portion of the partition.

According to the embodiment illustrated in FIG. 5 and in contrast to the embodiment of FIGS. 1 to 4, a front partition 64 is formed likewise of a lower structural member 65 and an upper structural member 66. The lower structural member 65 of the front partition 64 is substantially connected to that part of the gearbox 12, which is located below the cylinder 5, and forms an intermediate wall of the internal combustion engine, whereas the upper structural member 66, which on both sides is provided with a sound absorbing layer 67 and pertains to the front partition 64, is substantially screwed to the upper edge of the gearbox 12. Furthermore, there exists the possibility, depending on the specific installation conditions of the internal combustion engine 2, to provide a front partition 68, for instance, in the region above the cooling air blower, in conformity with FIG. 6, and for obtaining a greater stiffness to angle off the partition 68 toward the front, and in the region of the holder 49 to provide the front partition 68 again with an upper structural member 70 which extends substantially parallel to the lower structural member 69.

It is, of course, to be understood that the present invention is by no means limited to the specific showing in the drawings but also encompasses any modifications within the scope of the appended claims.

In this connection it may be mentioned that arrangements are possible, for instance, according to which the two lateral parts of the motor hood 36, 37 are individually connected to a front and rear lateral holder and that an upper part projects beyond the two lateral parts, the last mentioned upper part likewise being connected to a front and rear bearing. Furthermore, arrangements are possible according to which the lateral parts of the motor hood extend only over the length of the internal combustion engine while that part of the motor hood which precedes the partition according to the invention and is located above the front axle bearing block 8 is individually connected to a front and rear holder independently of the front partition, while on the front side and laterally of the front cover formed by these structural members, above the front axle bearing block 8 there are provided grille members for drawing-in cooling air and combustion air for the internal combustion engine 2. These grille members are either stationary or are pivotally mounted on one of the holders. In a similar manner, the arrangement according to the present invention is also applicable for installation in ship drives, construction machine drives, emergency current units, and compressor drives. In this connection it is only necessary to adapt the partition according to the invention to the respective conditions of use of the partition.

What I claim is:

1. An internal combustion engine which is air-cooled for tractor vehicles and driving units, comprising in combination: a crankcase, a plurality of cylinders, an outer mantle and at least one auxiliary machine arranged externally adjacent said crankcase, a V-belt driving means for said at least one auxiliary machine, cooling means for cooling said cylinders including a cooling air blower that provides a flow of air conveyed in a direction toward said at least one auxiliary machine to ventilate the outer mantle thereof, a front partition arranged transverse to the flow of the air conveyed in the direction of said at least one auxiliary machine and provided with an air withdrawing channel formed by at least one guiding separation wall including a rear partition and a lateral part arranged substantially transverse to said front and rear partitions as well as extending to one side thereof and preventing said cooling air from being short-circuited, the at least one auxiliary machine to be cooled being arranged laterally and above said crankcase within the region of one end face of said crankcase ahead of said front partition and is at least partially surrounded by said front partition as a container, a gearbox being connected to said front partition for noise reduction, a torsional vibration balancer smoothing V-belt running arranged ahead of said front partition, and wherein said V-belt driving means having a location preceding said front partition.

2. An air-cooled engine in combination according to claim 1, in which said front partition is fixedly connected to said gearbox by elastic means.

3. An air-cooled engine in combination according to claim 1, in which said front partition is made of elastic material.

4. An air-cooled engine in combination according to claim 1, in which said front partition is provided with lateral sealing lips located in the end faces engaging at least one of said guiding walls.

5. An air-cooled engine in combination according to claim 1, in which said front partition forms a holding means for auxiliary members of said vehicle.

6. An air-cooled engine in combination according to claim 5, in which said front partition forms at least a portion of a container for said auxiliary member.

* * * * *